US008123579B2

(12) United States Patent
Gerber

(10) Patent No.: US 8,123,579 B2
(45) Date of Patent: Feb. 28, 2012

(54) PROTECTION OF APPARATUS FOR CAPTURING WAVE ENERGY

(75) Inventor: James S. Gerber, St. Paul, MN (US)

(73) Assignee: Ocean Power Technologies, Inc., Pennington, NJ (US)

( * ) Notice: Subject to any disclaimer, the term of this patent is extended or adjusted under 35 U.S.C. 154(b) by 0 days.

(21) Appl. No.: 11/542,499

(22) Filed: Oct. 3, 2006

(65) Prior Publication Data

US 2008/0146103 A1 Jun. 19, 2008

(51) Int. Cl.

| | |
|---|---|
| ***B63B 22/00*** | (2006.01) |
| *B63B 9/08* | (2006.01) |
| *B63B 43/06* | (2006.01) |
| *B63B 43/08* | (2006.01) |
| *F03B 17/02* | (2006.01) |

(52) U.S. Cl. ..... 441/1; 114/121; 114/123; 114/125; 60/496

(58) Field of Classification Search ..... 441/100, 441/1, 28, 29, 32; 290/53; 60/495–498; 405/75, 76; 114/121, 123, 125; 417/330
See application file for complete search history.

(56) References Cited

U.S. PATENT DOCUMENTS

| | | | | |
|---|---|---|---|---|
| 4,603,551 | A * | 8/1986 | Wood | 60/496 |
| 5,052,902 | A * | 10/1991 | Labrador | 417/330 |
| 6,392,314 | B1 * | 5/2002 | Dick | 290/53 |
| 6,857,266 | B2 * | 2/2005 | Dick | 60/496 |
| 2005/0123353 | A1 * | 6/2005 | Dick | 405/75 |

FOREIGN PATENT DOCUMENTS

WO WO9517555 * 6/1995

* cited by examiner

*Primary Examiner* — Daniel Venne
(74) *Attorney, Agent, or Firm* — Henry I. Schanzer, Esq.

(57) ABSTRACT

For protecting surface floating wave energy converters (WEC's) against surface turbulence, the WEC's are removed from the water surface. For reducing the force required, the WEC's include a hollow member having an apertured outer wall. In the case where the WEC is to be lifted out of the water, the hollow member is normally submerged and full of water, and, during its lifting, water drains through the wall apertures thereby reducing the weight of the member and reducing the force required to lift it. In the case where the WEC is to be submerged, the hollow member is normally empty of water but fills with water through the wall apertures as the member is pulled beneath the surface. The weight of the water reduces the force required to submerge the member.

21 Claims, 8 Drawing Sheets

PROTECTION OF APPARATUS FOR CAPTURING WAVE ENERGY

BACKGROUND OF THE INVENTION

This invention relates to apparatus for converting energy present in surface waves on bodies of water to useful energy, and particularly to means for protecting such apparatus from storm induced surface turbulence by either raising the apparatus above or sinking it below the water surface.

Wave energy converters, referred to hereinafter as WECs, are known and described, for example, in co-pending application Ser. No. 10/762,800, filed Jan. 22, 2004, the subject matter of which is incorporated herein by reference. In the co-pending application, there are described two floats, one having an annular or tire-like configuration and floating in generally horizontal orientation. The other float is elongated (referred to hereinafter as a spar) and floats in vertical orientation inside the central opening of the annular float. Both floats bob up-and-down in response to passing surface waves, but generally in an out-of-phase relationship. When the annular float, for example, is rising, the spar generally tends to be sinking. The relative movements between the two floats are used for driving an energy converter, such as a linear electrical generator, for generating useful energy.

A problem associated with the use of a WEC disposed near or on the surface of a body of water is the danger that excessively large waves can cause damage to the WEC. A known practice for protecting a WEC in storm conditions is to sink it to a depth below the surface zone of turbulence. While such deliberate sinking of the WEC can be done by flooding a ballast tank, as in a submarine, this requires elaborate and expensive apparatus including a source of pressurized air for blowing the flooded tanks.

Another technique for sinking a WEC comprises winding an anchoring cable of the WEC around a motor driven drum on the floor of the water body and forcibly dragging the WEC to a safe depth. A problem here, however, is that for highest energy generating efficiency, the WEC preferably has substantial reserve buoyancy (i.e., is subject to a substantial buoyant force when the instantaneous water surface is elevated relative to the calm condition waterline of the WEC). But the greater the reserve buoyancy of the WEC, the greater is the force required not only to sink the WEC but for controlling its rate of ascent when the WEC is resurfaced. The greater the sinking and elevating forces, the larger must be the overall system including an anchor of sufficient strength for withstanding the applied forces, and the more complex must be the mechanisms to hold the WEC in and release the WEC from a submerged state.

An alternative practice for protecting a WEC, usable in situations where the WEC is suspended from a support structure, for example, an ocean platform, is to pull the WEC upwardly out of the zone of influence of the waves. There is a problem in this approach which is analogous to the problem of submerging the WEC: for the WEC to be efficient, it has to displace a substantial weight of water, because this displaced weight is approximately equal to the maximum force experienced by the WEC when the instantaneous water surface drops below the calm condition waterline. The substantial weight required for efficient wave energy conversion however, poses onerous requirements on the mechanisms required to pull the WEC upwardly out of the water and to eventually release the WEC in a controlled manner.

The present invention is directed to means for reducing the amount of force required for moving a WEC from its normal surface floating position to a position of safety.

SUMMARY OF THE INVENTION

A normally highly buoyant float for use in a WEC comprises two vertically stacked components. A first of the components is of fixed buoyancy and the second component comprises a hollow vessel having an outer wall including a number of holes there through admitting flow of water into and out of the vessel.

In the instance where the WEC is to be pulled beneath the water surface for storm protection, the apertured component is the upper of the stacked components. As the apertured component is pulled beneath the water surface, it begins to fill with water thereby increasing its weight and reducing the amount of force required to sink it. However, even when the upper vessel is completely filled with water, the buoyancy of the lower vessel is sufficiently high that the WEC remains slightly buoyant. This allows the WEC to automatically resurface when the submerging force is removed. When resurfaced, and under safe operating conditions, the water in the upper vessel gradually drains through the wall openings for returning the WEC to high buoyancy.

In the instance where the WEC is to be lifted out of the water for storm protection, the apertured compartment is the lower of the two stacked components and, during normal energy producing usage, is fully submerged and completely full of water. Buoyancy for the WEC is provided by the upper component. As the WEC is pulled upwardly out of the water, the water within the apertured component drains outwardly through the wall openings thus decreasing the weight of the WEC and reducing the amount of force required to raise it.

BRIEF DESCRIPTION OF THE DRAWINGS

The drawings are schematic and not to scale.

DESCRIPTION OF PREFERRED EMBODIMENTS OF THE INVENTION

Figure 1:
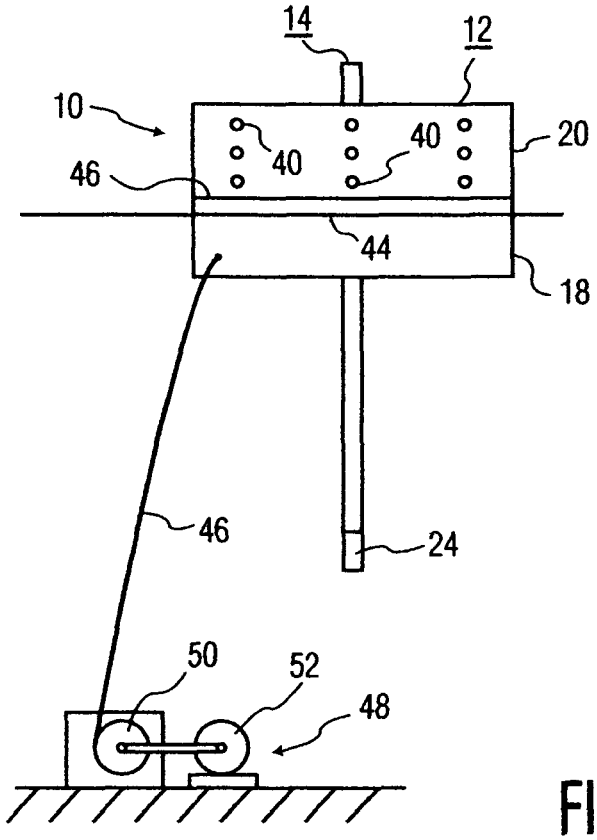
FIG. 1 is a side view of a WEC in accordance with this invention floating on a flat surface of a body of water; the WEC being tethered to an anchor assembly on the water body floor for, when necessary, pulling the WEC beneath the water surface.
Figure 2:
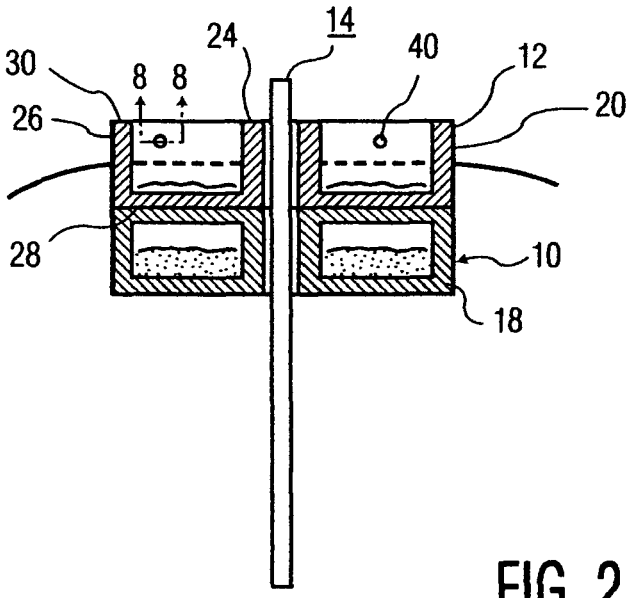
FIG. 2 is a cross-sectional view of the WEC shown in FIG. 1 and shows water contained within a two-component float of the WEC, the upper of the two components having holes through an outer wall thereof.

FIGS. 1 and 2 show an illustrative WEC 10 in accordance with the present invention. The WEC includes two floats 12 and 14. The float 12 comprises two secured together annular members 18 and 20, and the float 14 (spar) comprises a single elongated member extending through the central opening of the two member (composite) float 12. The lower end 24 of the spar 14 is weighted to maintain the spar in vertical orientation. In this embodiment, the spar 14 is a closed cylinder having fixed buoyancy. The spar 14 can be hollow or at least partially filled with a ballasting material, for example, water.

As previously described, WECs are typically protected against storm damage either by being lifted above the water surface or by being sunk below the surface. The WEC 10 shown in FIGS. 1 and 2 is of the type designed for protection by sinking and, to this end, the lower member 18 of the composite float 12 is of fixed buoyancy and can be hollow or at least partially filled with water. The upper member 20 of the composite float comprises a normally hollow vessel defined by inner 24 and outer 26 walls and a bottom wall 28. In FIGS. 1 and 2, the upper end 30 of the vessel 20, which is optionally open or closed, is open. Also, the outer vessel wall 26 includes a plurality of holes 40 therethrough. The diameters of the holes are sufficiently small for allowing only a relatively small amount of water flow into and out of the vessel during the passage of single waves past the WEC. The purpose of the holes is described hereinafter.

The WEC is anchored in place by an anchor cable 46 which extends, first, to an auxiliary buoy 47 for supporting the weight of the cable 46, and then to an anchor assembly 48 on the floor of the water body. (Although not shown herein, the anchor cable 46 preferably extends, along the water surface, from the WEC 10 to an auxiliary buoy which supports the weight of the cable between the water surface and the anchor assembly.) As shown schematically, the cable 46 is wrapped around a drum 50 rotatable in either direction by a motor 52. The anchor assembly 48 can be embedded in the water body floor or, more simply, is of sufficient weight for remaining stationary against the lifting forces from the WEC.

To the extent described, and ignoring the holes 40 in the wall of the vessel 20, the vessel 20 is simply a part of the float 12 contributing to the buoyancy of the WEC. The buoyancy of the float 12 is such that, when the float is floating on a perfectly flat surface of a body of water, the intercept of the water surface with the float is along a line 44 slightly below the interface 46 between the upper 20 and lower 18 members of the float 12. As cresting waves pass the float 12, the rising water level increases the volume of water displaced by the float for increasing the buoyancy of the float for lifting it against the load provided by the energy converter (not shown) connected between the two floats 12 and 14.

The holes 40 through the vessel 20 walls allow entry of water into the vessel. The purpose of the holes 40 is now described.

Figure 3:
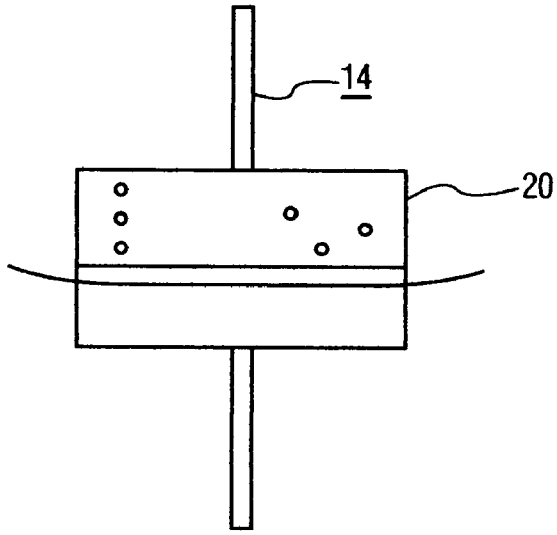
FIG. 3 is similar to FIG. 1 but shows the WEC floating within a wave trough.

As shown in FIG. 2, a cresting wave tends to rise upwardly along the float and to overlap the holes 40 through the vessel wall 26. How high the wave crest rises along the wall 26 is a function of the wave amplitude and the rate at which the float 12 rises with the cresting waves. Each wave crest, as shown in FIG. 3, is followed by a wave trough during which the water surface is below the vessel 20 and below the holes 40. Water from the passing waves thus flows into the vessel 20 during the wave crests and drains from the vessel during the wave troughs. As noted, the holes 40 are of a relatively small diameter, and taking into account the wave period and the duration of each wave crest, the maximum flow of water into the vessel 20 during the passing of each wave crest is relatively small. While the water is within the vessel, and until the water drains there from, the weight of the vessel is increased and its buoyancy decreased. Under normal wave conditions, the maximum buoyancy decrease is relatively small and with little affect on energy production.

However, under storm conditions when it is desired to submerge the WEC for safety purposes, the motor 52 (FIG. 1) is activated to begin winding the WEC anchor cable 46 onto the drum 50. As the volume of the WEC being pulled beneath the water surface increases, the force required to sink the WEC also increases. However, once vessel holes 40 sink beneath the water surface, water flows into the vessel 26 without subsequent draining, as with passing wave crests, and the weight of the water within the vessel decreases the force necessary to further submerge the WEC. The overall buoyancy of the WEC remains positive even as the vessel 26 completely fills with water. Accordingly, some force must be applied to completely submerge the WEC. However, the total force required to sink the WEC is considerably reduced in comparison with the sinking force required absent the holes.

Specifically, if the vessel 26 contained no through holes 40, the force required to completely submerge the WEC is equal to the weight of water corresponding to the volume of the WEC between the flat surface intercept line 44 (FIG. 1) and the upper end 30 of the vessel 26. Such volume is the amount of water to be displaced for completely submerging the float 12 from its normal floating depth. With the holes 40, and allowing the vessel 26 to fill completely with water during the sinking process, the force required to submerge the WEC is reduced to being equal only to the weight of water corresponding to the volume of the WEC between the water intercept line 44 and the interface 46 between the two members 18 and 20. Such force reduction is because the weight of the water filling the vessel 26 provides the force necessary to sink that volume of the float 12 corresponding to the volume of the water filled vessel 26.

As noted, the buoyancy of the WEC is such that even with the vessel 20 completely filled with water, positive buoyancy remains. Thus, when the storm conditions have abated and it is safe to resurface the WEC, the cable 46 is unwound from the drum 50 to allow the buoyant WEC to float to the surface. The WEC positive buoyancy is sufficiently high that an upper portion of the water filled vessel 20, including some through holes 40, extends above the water surface. Draining of the vessel through the holes then begins and continues until normal buoyancy of the WEC is reached.

Another advantage of filling the submerged vessel 20 with water is that, during the re-surfacing of the WEC, its buoyancy remains reduced thereby reducing the risk of the WEC escaping from its anchoring restraint and racing at an uncontrolled and dangerous speed to the surface.

As shown in FIG. 2, the upper end 30 of the float 12 is open. An advantage of this is that, during approaching storm conditions, once the wave crests become so high as to reach over the top end of the float, the vessel 20 immediately fills with water for immediately reducing the WEC buoyancy. Accordingly, even prior to protectively submerging the WEC, the decreased buoyancy WEC is less responsive to wave action and less likely to be damaged by waves of excessive amplitude. Also, less force is required to submerge the WEC.

A disadvantage of an open top end is that complete filling of the vessel 20 can occur even under safe operating conditions in response to the passage of a random wave crest of extra high amplitude. While the WEC would not sink, decreased efficiency operation results until the water drains from the vessel.

A compromise arrangement is to close the upper end 30 of the vessel 20, but to provide larger diameter holes 40 through the vessel wall 26 towards the upper end 30. Thus, as the wave amplitudes begin to build in response to an approaching storm, the rate of water flow into and out of the vessel 20 increases in proportion to the increased wave amplitudes. But, if only an occasional large amplitude wave completely enveloping the vessel 20 arrives during otherwise normal conditions, the closed upper end 30 of the vessel 20 prevents complete filling of the vessel 20, and less time is required for draining the extra water from the vessel.

Figure 4:
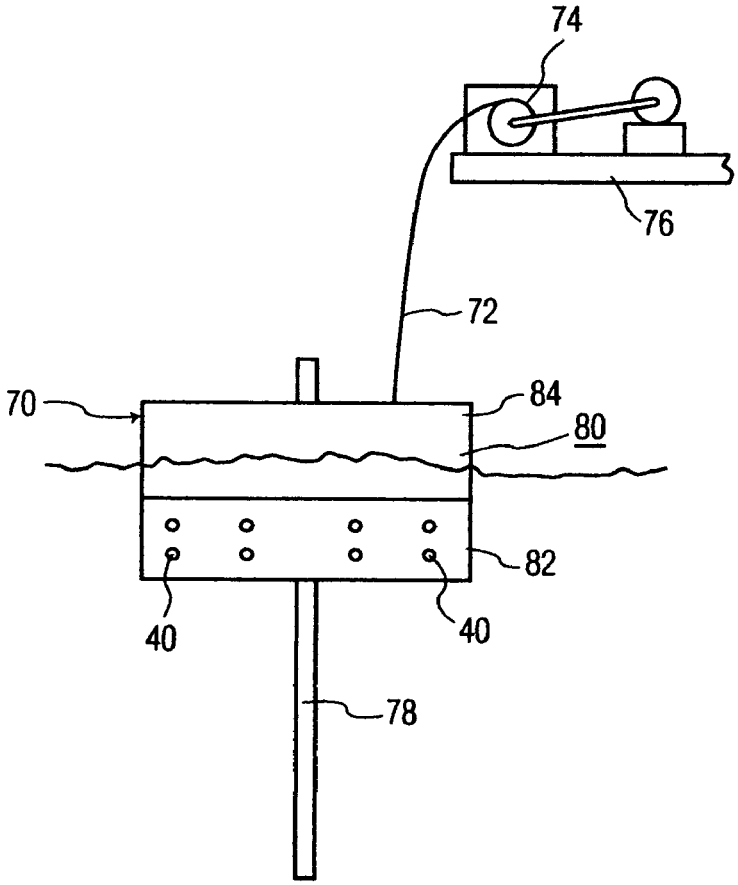
FIG. 4 is a view similar to FIG. 1 but showing a WEC tethered to an above-water structure for pulling the WEC upwardly out of the water.

FIG. 4 is a view of a WEC 70 designed for protection against storm damage by being lifted upwardly out of the water by means of a cable 72 attached, for example, to a motor-driven pulley 74 mounted on an above-surface structure, for example, an ocean platform 76 (indicated only schematically).

In this embodiment, the WEC 100 is similar to the WEC 10 shown in FIGS. 1-3 in that it comprises an elongated spar float 78 extending through a central aperture of an annular float 80 comprising two secured together annular members 82 and 84. The two members are similar to the two members 18 and 20 shown in FIG. 1 in that the member 82 is a closed container while the member 84 includes a plurality of openings 40 through the outer wall thereof. A difference between the float 12 shown in FIG. 1 and the float 80 shown in FIG. 4, however, is that in FIG. 4 the apertured member 80 is disposed below the closed member 82.

In normal, energy producing usage, the lower, apertured member 80 is completely submerged and full of water. Buoyancy for the WEC is provided by the upper, closed member 82.

Under approaching storm conditions, the WEC 70 is lifted upwardly out of the water by known means, such as above-described. As the apertured member 80 is lifted out of the water (whereby its weight would normally increase) the water contained in the lower member 80 drains there from the member 200 through the wall openings 40, thereby decreasing the weight of the WEC and reducing the amount of force required to lift it.

As described, a feature of the invention is that the WEC's include hollow vessels intended, under certain circumstances, to be partially or completely filled with water. A problem, however, is that when water is introduced into a compartment in any non-fixed maritime structure, tilting motions of the structure in response to wave action can induce rapid motions of the water, or "sloshing". This sloshing can have a detrimental effect on stability and can impede desired dynamic behavior. Additionally, the water, if unrestrained, flows to the lower side of the compartment in response to the tilting motions of the structure. This tends to enhance the tilting movements and further jeopardize structural stability.

A known solution in similar situations is the use of impervious vertical walls or barriers within liquid containing compartments to stop internal water flows. However, this solution is inadequate in conjunction with WECs used in accordance with the present invention because wave conditions may exist which cause water to flow preferentially into one of the compartments, accumulate therein in excess of the mass of water in other compartments, and thus accentuate tilting of the structure.

In accordance with this invention, porous baffles are disposed within a WEC float sub-dividing the float interior into multiple compartments. The compartments are individually small enough to minimize sloshing effects, but are interconnected such that uniform distribution of the water among the compartments occurs regardless of any particular direction of arrival of surface waves.

Figure 5:
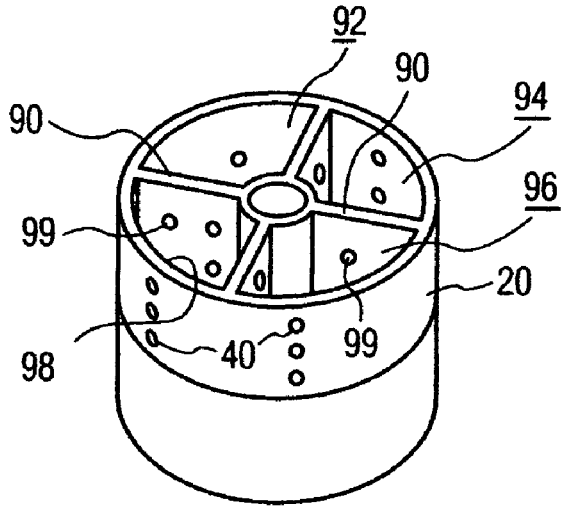
FIG. 5 is a view in perspective showing a float, similar to that shown in FIGS. 1 and 2, but including baffles within the float for reducing sloshing movements of water contained within the float.
Figure 6:
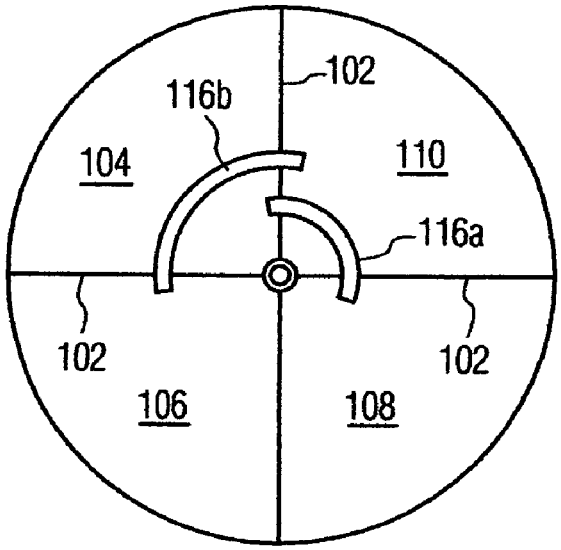
FIGS. 6 and 7 are plan views of floats similar to that shown in FIG. 2 but including small tubes for distributing water between internal compartments of the float.

In FIG. 5, for example, four plates 90 are disposed, in vertical orientation, within the interior of the upper compartment 20 of a float identical to the float 10 shown in FIGS. 1 and 2. The plates 90 sub-divide the float interior space into four separate compartments 92, 94, 96 and 98, each isolated from the others to the extent that sloshing movements in one compartment are substantially isolated from, and do not contribute towards sloshing movements in other compartments. However, while the plates inhibit free flow of water between compartments, the plates are pervious, e.g., by including a pattern of small openings 90 there through, to allow water flow between compartments for obtaining uniform distribution of the water over time.

In an alternative arrangement, the compartment forming plates are impervious to water, but each compartment is connected to a spaced apart compartment via a tube through which water can flow in moderate volume for obtaining uniform distribution of the water. In FIG. 5, for example, two spaced apart compartments 104 and 108 are interconnected by a tube 116*a* which passes through compartment 110. Likewise, compartment 106 is connected to compartment 110 via a tube 116*b* which passes through compartment 108.

Figure 7:
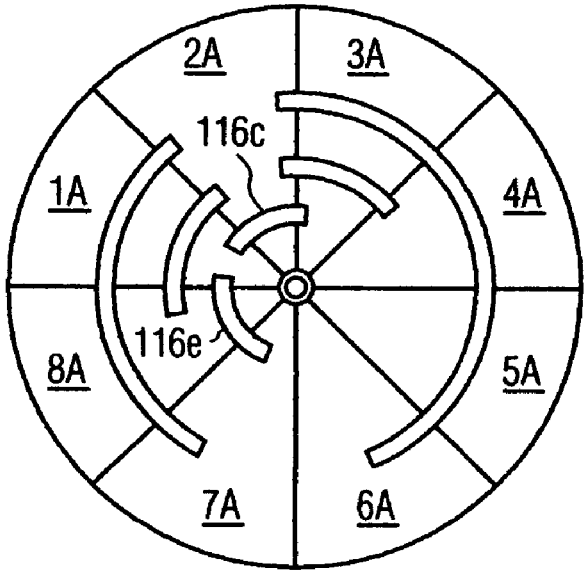

This concept can be applied to any symmetrical disposition of compartments. If there are eight compartments, such as shown in FIG. 7, for example, labeled 1A, 2A, . . . 8A, then compartment 1A can be connected to compartments 3A, 5A and 7A by respective tubes 116*c, d* and *e*. Likewise, compartment 2A can be connected to compartments 4A, 6A and 8A.

In the embodiment of the invention shown in FIGS. 1-3, the apertured member 20 floats above the water surface. Still, during normal use, some water is always present in the member 20. This occurs because water flows in when a wave rises, and flows out when the wave crest recedes. In most practical applications of the invention, some equilibrium will be reached in steady waves with a relatively constant amount of water in the upper chamber. It is desirable to have this amount of water be minimal, since the presence of this water does not benefit the wave energy conversion process. A preferred way to minimize the amount of water inside the upper chamber in operational wave conditions is by providing at least some of the wall holes with valves so that fluid flow is preferentially outward. Thus, it would be possible to arrange, say, a ratio of 5 valves which only allow outward flow to 1 hole which allows bi-directional flow. This assures that almost all water which comes in during a wave crest flows out during the subsequent wave trough.

Figure 8:
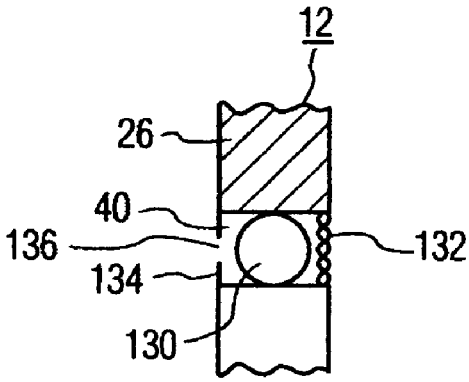
FIG. 8 is a cross-sectional view taken along line 8-8 in FIG. 2.

FIG. 8 shows an example of one of numerous types of known valves that can provide directional flow. Shown in the drawing is a hole 40 through an outer wall 26 of a float 12 such as shown in FIG. 2. The interior of the float is to the left of the wall segment shown. Disposed within the hole is a ball 130 which is movable in either direction in response to water flow through the hole 40. When water is flowing out of the float, i.e. from left to right, the ball is moved into contact with a mesh 132 overlying the hole which, while blocking escape of the ball, allows flow of water past the ball and through the mesh. Conversely, when water tends to flow through the hole 40 from right to left, the ball moves into sealing engagement with a gasket 134 for sealing an opening 136 through the gasket.

Other, suitable valves are known.

Now described is a method of determining the amount of water in the apertured upper vessel 20 of the float 12 shown in FIG. 1. For ease of illustration, the float 12 is shown in FIG.

Figure 9:
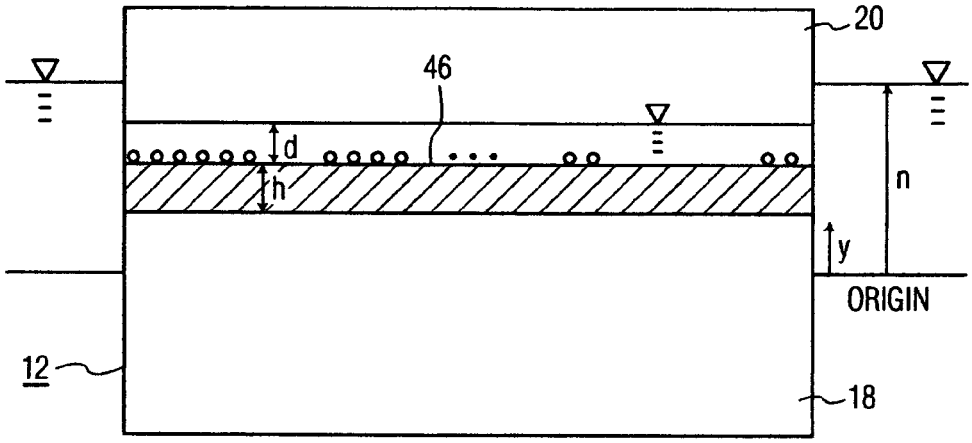
FIG. 9 is a view of a surface float similar to the surface float shown in FIG. 1 but identifying certain parameters relevant to the flow of water inwardly and outwardly of the float.
Figure 9A:
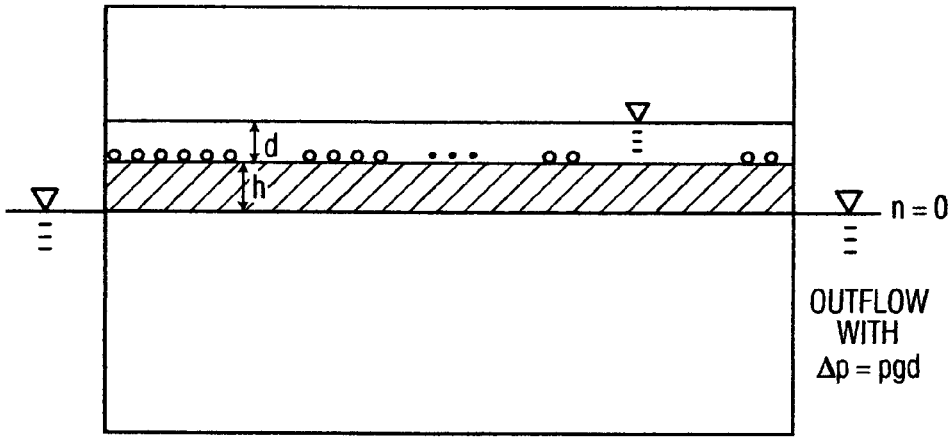
FIGS. 9A-9F are views similar to that of FIG. 9 but identifying the direction of water flow into or out of the surface float as a function of instantaneous wave amplitude.
Figure 9B:
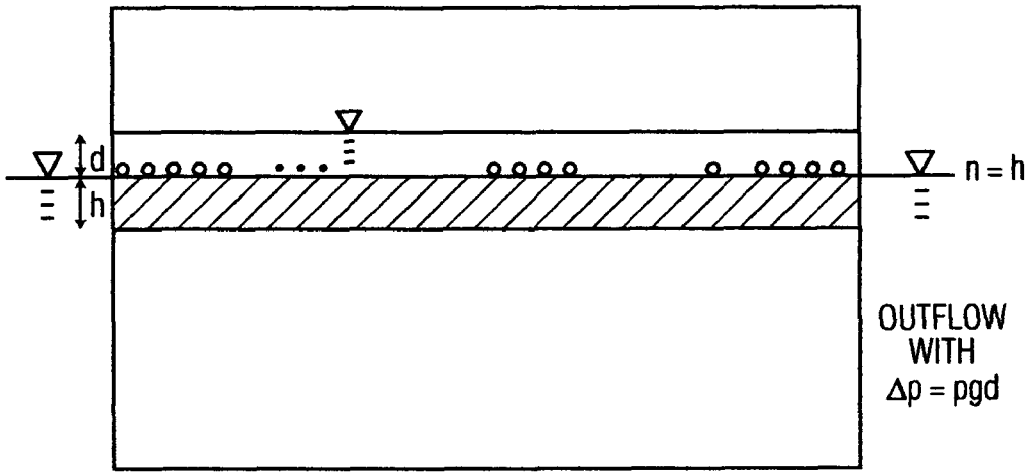
Figure 9C:
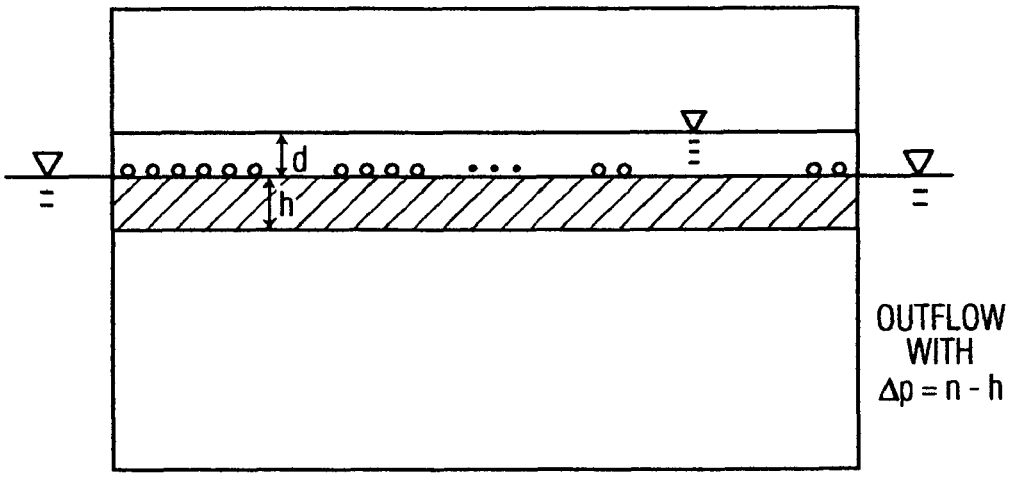
Figure 9D:
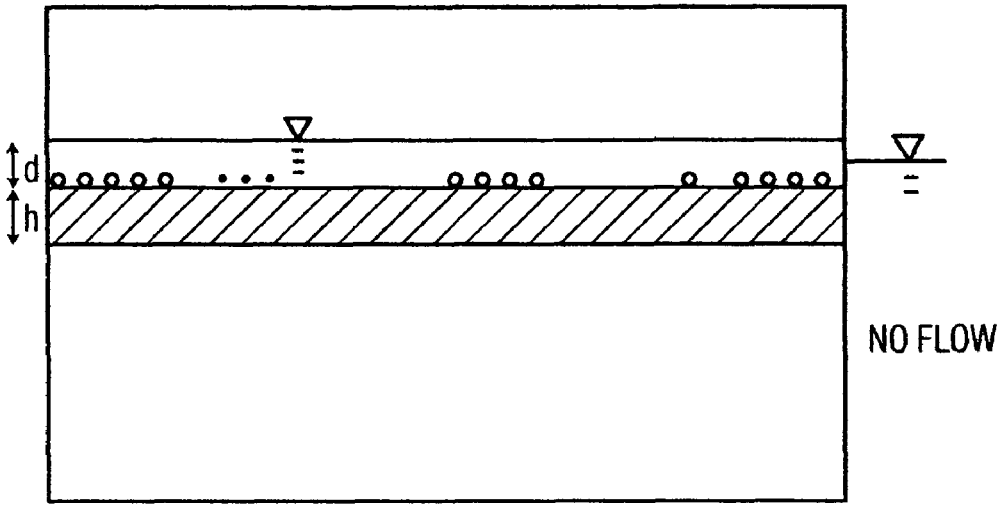
Figure 9E:
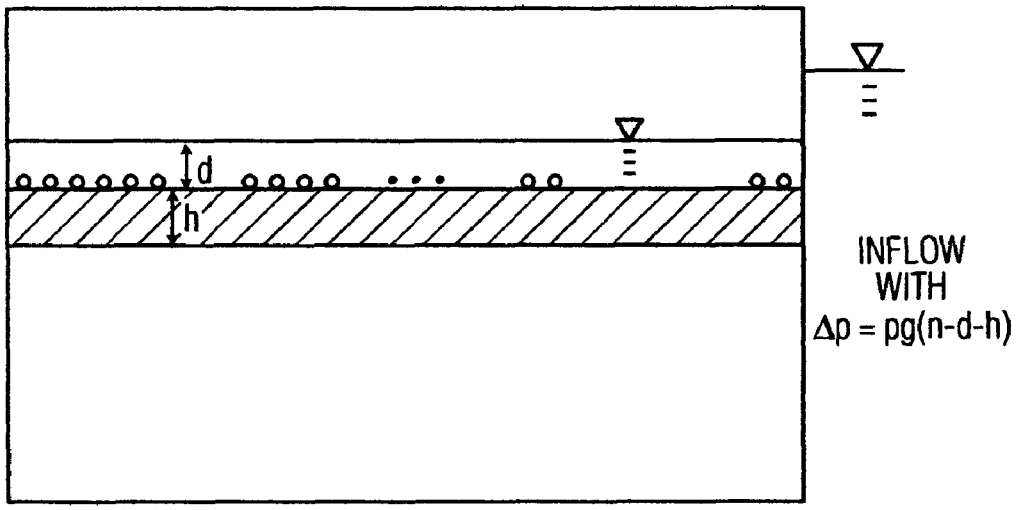
Figure 9F:
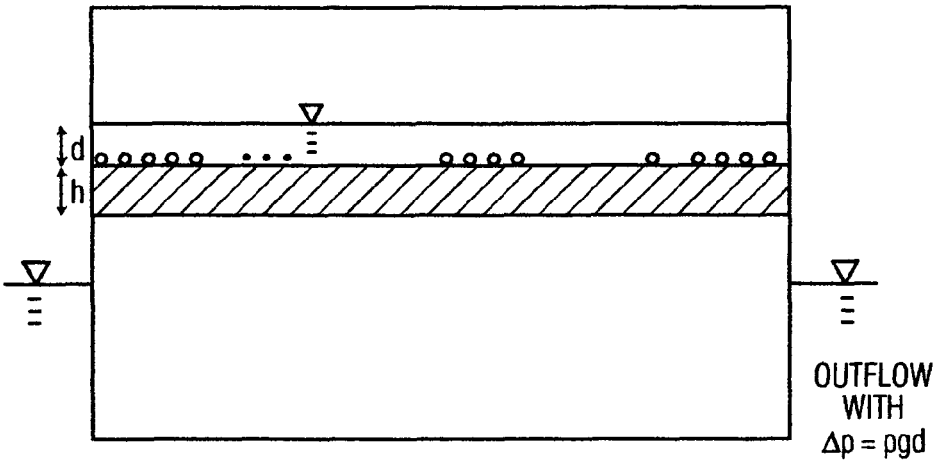

9 on a slightly larger scale than that of FIG. 1. As previously described, the float 12 comprises two components 18 and 20 in vertically stacked relationship. The interface between the two components is identified by the reference numeral 46. A schematic of the drawing is shown in FIG. 9. Quantities displayed include:

y Vertical displacement of device from mean waterline n Vertical elevation of water surface from mean waterline h Height from waterline to draining orifices in upper chamber d Amount of water remaining in the upper chamber in the steady state When the wave elevation n is sufficiently high that n>y+h+d, then water flows into the upper chamber. Otherwise, water flows out of the upper chamber.

When the inflow condition occurs, the rate of inflow is proportional to the square root of the differential pressure across the valves, multiplied by some constant relating to the orifices.

For simplicity, the following assumptions are made:

All valves are located just above the interface between the upper and lower chambers.

The incident wave is sinusoidal, with an amplitude $n_0$

The WEC does not move.

The amount of inflow/outflow is sufficiently small with each passing wave that the height d of the water in the upper chamber is assumed to be constant.

Figure 10:
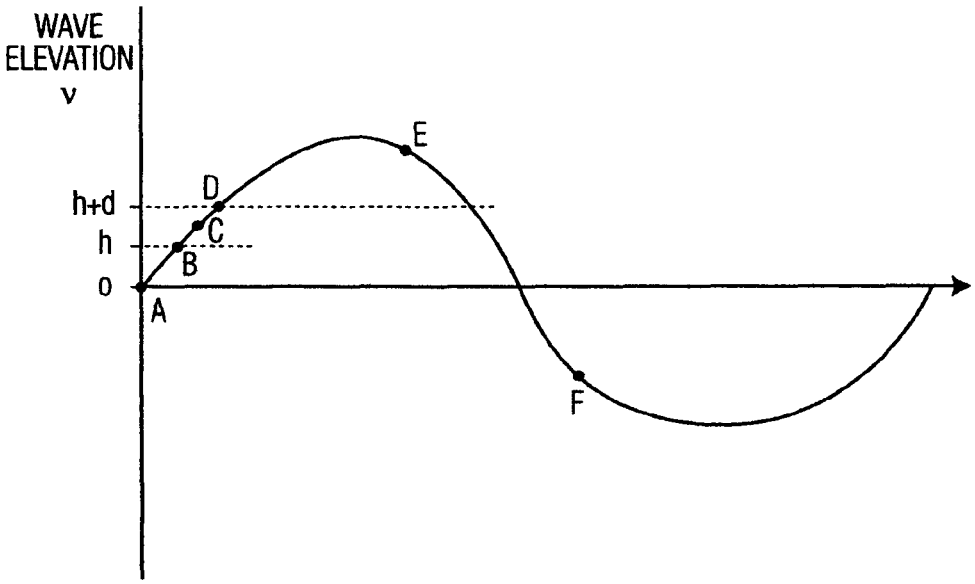
FIG. 10 is a graph showing the approximate relationship of amplitude versus time (a sine wave) of a surface wave and identifies, by letter, certain wave amplitudes discussed in the specification.

FIG. 10 shows a single wave cycle, and indicates 6 points of interest labeled A, B, C, d, E, F, which correspond to distinct regimes of inflow/outflow. These points are shown in FIGS. 9A to F, respectively, and are described below.

A: The wave elevation is right at the mean free surface. There is outflow, and the rate of outflow is governed by some orifice-specific constants multiplied by the square root of the pressure, which is given by pg(d).

B: The wave elevation is at the interface between upper and lower chambers. There is outflow, and constants multiplied by the square root of the pressure, which is given by pg(d).

C: The wave elevation is less than h above the interface between upper and lower chambers. There is outflow, and the rate of outflow is governed by some orifice specific constants multiplied by the square root of the pressure, which is given by pg(n-h).

D: The wave elevation is at the same height as the surface of the water inside the upper chamber. There is no net flow into or out of the upper chamber.

E: The wave elevation is at a greater height than the surface of the water inside the upper chamber. There is a net flow into the chamber. The rate of inflow is governed by some orifice specific constants multiplied by the square root of the pressure, which is given by pg(n-h-d).

F: The wave elevation is below the waterline of the WEC. There is outflow, and the rate of outflow is governed by some orifice specific constants multiplied by the square root of the pressure, which is given by pgd.

Analysis of this simplified case shows the following:

1) That an equilibrium of the amount of water inside the upper chamber will be reached in typical conditions (i.e., where the wave amplitudes are greater than h, and not substantially greater than the height of the device).

2) That this equilibrium is affected by the height h of the interface between upper and lower chamber.

3) That it is desirable to have a different set of orifice-specific constants governing inflow and outflow.

1—Equilibrium is reached. Consider FIG. 10. The time where water flows out of the upper chamber is limited to the interval when the wave elevation is greater than the dotted line indicated by h+d. Suppose that the level of water is rising in the chamber with each cycle. Equilibrium will eventually be attained because the amount of water flowing in on each cycle will decrease as the duration of said interval decreases.

2—Equilibrium is affected by the height h. As height h is increased, the interval over which water flows into the upper chamber decreases in duration, which affects the equilibrium.

3—It is desirable to have a different set of orifice-specific constants governing inflow and outflow. It is desirable in practice to have the height h and the height d both be relatively small. If both are small, then the interval of time over which water is free to flow into the chamber is almost a full half-cycle. However, since the rate of inflow is proportional to the square root of the pressure differential, there will be much more water flowing in than out. Equilibrium will be reached, as described above. However, equilibrium won't be reached until the level d of water inside the upper chamber has grown relatively large. Thus, if inflow and outflow are not symmetric, it is possible to design the flow rates so that the equilibrium levels have desired properties.

What is claimed is:

1. A method of protecting a surface wave energy converter (WEC) against damage by submerging the WEC, said WEC comprising a float including a first component overlying a second component, said first and second components being secured to each other, and said first component enclosed by a wall having a hole therethrough providing access to said first component, the method comprising:

floating said float such that, under normal wave conditions, with the waves having crests and troughs, the float moves generally in phase with the waves on the surface of a body of water with said hole being generally disposed above the surface of the water such that the water flowing into said first component during wave crests drains from the first component during wave troughs and for which condition the WEC is designed to generate power; and, submerging the float under storm conditions for protecting the WEC against damage including the step of developing a force for initially only partially submerging the float and said hole for allowing more water to enter said first component than is drained from said first component for reducing the amount of force required to thereafter fully submerge the WEC.

2. A wave energy converter (WEC) including two floats, one of said two floats having first and second components secured to each other, the first component of said one float designed to be of fixed buoyancy to cause movement of said one float in phase with the waves under normal wave conditions defining a condition during which the WEC is designed to generate power, and (b) the other one of said two floats, also referred to as a spar, comprising an elongated member;

said one float designed to have a buoyancy for floating on a surface of a body of water for generating power when it moves relative to the spar in response to passing surface waves under normal wave conditions, and the second component of the one float including a vessel for decreasing the buoyancy of said one float under storm conditions and thereby causing the submergence of said one float below the surface of the body of water.

3. A WEC according to claim 2 wherein said second component includes an interior space for receipt of variable quantities of water for providing said variable buoyancy.

4. A WEC according to claim 3 wherein said interior space is sub-divided into separate compartments, with each compartment being in water flow communication with a respective compartment spaced apart from said each compartment by an intervening compartment.

5. A WEC according to claim 2 wherein said second component includes baffles within said interior space for impeding sloshing of water within said space.

6. A WEC according to claim 2 wherein, when the WEC is in use, said two components are in contiguous vertically stacked upper and lower relationship.

7. A WEC according to claim 6 wherein said second component includes an outer wall having a hole there through for passing water into and out of said second component.

8. A WEC according to claim 7 wherein said hole is one of several holes circumferentially distributed around said wall.

9. A WEC according to claim 7 wherein said hole has an associated mechanism which causes water to flow preferentially in the direction from inside to the outside of said second component .

10. A WEC according to claim 7 wherein the buoyancy of said one float is such that, when the WEC is disposed in a body of water having a flat surface, said second component floats above the surface of said body.

11. A WEC according to claim 10 wherein said first and second components are joined at an interface spaced, when the WEC is in use, above said water body flat surface, said hole being disposed closely adjacent to said interface.

12. A WEC according to claim 11 wherein said hole is one of several vertically spaced apart holes extending from said interface to the upper end of said second component.

13. A WEC according to claim 3 wherein said one float has positive buoyancy when said second component is filled with water.

14. A WEC according to claim 3 including means for submerging the WEC below the surface of the body of water in which the WEC is being used, and said second component including an outer wall having an opening there through for filling said second component with water upon the submergence of said one float.

15. A WEC according to claim 4 wherein the buoyancy of the WEC remains positive upon said filling of said second component with water.

16. A WEC according to claim 7 wherein said hole has an associated mechanism which allows water to flow preferentially in the direction from inside to the outside of said second component.

17. A method of lifting a surface wave energy converter (WEC), said WEC comprising a float including a first component underlying a second component said first and second components being secured to each other, and said first component enclosed by a wall having a hole therethrough providing access to said first component, the method comprising:

floating said float so it moves generally in phase with the waves on the surface of a body of water with said hole being generally disposed below the surface of the water; and lifting the WEC above the surface of the body of water including the step of developing a force for initially partially lifting the float to a level such that said hole is above the surface of the water to drain water from said first component for reducing the amount of force required to thereafter fully raise the WEC.

18. A wave energy converter (WEC) including two floats, one of said two floats having first and second components secured to each other, said first component underlying said second component and having a buoyancy which can be varied, the second component of said one float designed to be of fixed buoyancy and cause movement of said one float in phase with the waves under normal wave conditions defining the WEC's normal operating condition during which the WEC is designed to generate power, and (b) the other one of said two floats comprising an elongated member;

said one float designed for floating on a surface of a body of water for generating power when said one float moves relative to the other one of said two floats in response to passing surface waves exhibiting normal wave conditions, and the first component of the one float including a vessel enabling the buoyancy of the one float to be increased for easing the lifting of the first float above the surface of the body of water.

19. A method of protecting a surface wave energy converter (WEC) against damage by submerging the WEC, said WEC comprising a float including a first component whose buoyancy can be varied overlying a second component of fixed buoyancy, said first and second components being secured to each other, the method comprising:

floating said float so the float moves generally in phase with the waves on the surface of a body of water under normal wave conditions and for which condition the WEC is designed to generate power; and decreasing the buoyancy of the first component under storm conditions for gradually submerging the float and protecting the WEC against damage.

20. A wave energy converter (WEC) including two floats, (a) one of said two floats designed to have a buoyancy for movement in phase with the waves under normal wave conditions, defining the WEC's normal operating condition during which the WEC is designed to generate power, (b) the other one of said two floats comprising an elongated member, also referred to herein as a spar; and said one of said two floats designed for floating on a surface of a body of water for generating power when it moves relative to the spar in response to passing surface waves exhibiting normal wave conditions, and said one of said two floats including a vessel for reducing the buoyancy of said one of said two floats in response to storm conditions for submerging said one of said two floats below the surface of the body of water.

21. A wave energy converter (WEC) as claimed in claim 20 wherein the vessel for reducing the buoyancy of said one of said two floats includes first and second components secured to each other with the first component overlying the second component, and said first component is enclosed by a wall having a hole therethrough providing access to said first component.

* * * * *